US005799374A

United States Patent [19]

Strobel et al.

[11] Patent Number: 5,799,374

[45] Date of Patent: Sep. 1, 1998

[54] SPINNING MACHINE FOR THE DOUBLING OR STRETCHING OF FIBER BANDS

[75] Inventors: Michael-Maria Strobel, Eichstätt; Wolfgang Göhler, Lenting; Manfred Wagner, Ingolstadt, all of Germany

[73] Assignee: Rieter Ingolstadt Spinnereimaschinenbau AG, Ingolstadt, Germany

[21] Appl. No.: 768,041

[22] Filed: Dec. 18, 1996

[30] Foreign Application Priority Data

Dec. 27, 1995 [DE] Germany ..... 195 48 840.7

[51] Int. Cl.[6] ..... D04H 5/46

[52] U.S. Cl. ..... 19/274; 19/267; 19/258; 19/271

[58] Field of Search ..... 19/236, 244, 242, 19/245, 248, 250, 258, 260, 261, 265, 266, 267, 268, 271, 274, 276, 294, 295

[56] References Cited

U.S. PATENT DOCUMENTS 2,666,231 1/1954 Stahlecker ..... 19/266
2,958,103 11/1960 Schrotz ..... 19/266
4,768,262 9/1988 Gunter ..... 19/266
4,969,238 11/1990 Schrotz ..... 19/266

*Primary Examiner*—C. D. Crowder
*Assistant Examiner*—Larry D. Worrell, Jr.
*Attorney, Agent, or Firm*—Dority & Manning

[57] ABSTRACT

A spinning machine for the doubling or stretching of fiber bands with a rolling section having lower rolls which are secured in journal blocks, and wherein the upper rolls may be also secured on said journal blocks with pressure means for the loading of said upper rolls, it is proposed that the pivoting axis of the pressure arm for the placement of the pressure means to the upper rolls be arranged in such a way that, when observed in the running direction of the fiber band, said axis lies behind the rolling section. Advantageously, what is achieved thereby, is that the spinning machine can be maintained in a considerably simpler and quicker manner. Following the upward pivoting of the pressure arm, the entire area of the rolling section becomes freely accessible. The pivoting geometry of the pressure arm can be so varied, that the upper rolls can be easily restored into the guides on the journal blocks of the lower rolls.

21 Claims, 4 Drawing Sheets

SPINNING MACHINE FOR THE DOUBLING OR STRETCHING OF FIBER BANDS

BACKGROUND OF THE INVENTION

A spinning machine of the manufacturer, Rieter Ingolstadt Spinnereimaschinenbau AG, 85049 Ingolstadt, namely a stretcher and doubler, is already known in the industry. For the loading of the upper rolls, two pressure means are provided per upper roll, which are arranged on pressure arms. One pressure arm applies the pressure means on one side of the upper roll, the other pressure arm does so on the other side. Both pressure arms are firmly linked to one another so that they swing commonly about one pivoting axis. A pivoting of the pressure arms is then necessary, when access to the rolling section is desired. This access is required, for instance, in order to rethread a broken fiber band into the rolling system or when the rolling section rolls are maintained or replaced. The pivoting axis of the pressure arm lies in the back of the rolling section as viewed in the direction of the running fiber band. The pressure arms are to be interlocked by means of an interlocking apparatus which is installed in the front of the rolling section as seen in the direction of the running band. Thereby, the pressure means are brought into force upon the upper rolls.

The rolling section of the known spinning machines has the disadvantage that the pivoting axis of the pressure arms is located in front of the section as seen along the running direction of the band, whereby upon maintenance to said section, the pressure arm, which is swung overhead, hinders the activity of the service person. In particular, access is made especially difficult to the area in front of the rolling section, as seen in the running direction of the band. In this zone, for instance, upon a break in the fiber band, this band must be reintroduced into the rolling section under the pivoted assembly of said rolling section. A further disadvantage of the known rolling section is, that the upper rolls of the rolling section, as well as the cleaning rods of the upper rolls do not swing away upon the pivoting of the pressure arms. They remain, rather, in the journal blocks of the lower rolls, in which these are embedded.

Another spinning machine is made known from the European patent 0 359 914 B1, wherein each pressure arm of the rolling section of this machine is divided into two parts and the second part is swivelable about an axis, which runs parallel to the first. The proposed achievement was to be able to align all upper rolls with corresponding lower rolls by a rotating motion. This rolling section has the disadvantage that it requires a costly interlocking apparatus.

OBJECTS AND ADVANTAGES OF THE INVENTION

The purpose of the present invention is then, to design a spinning machine in such a manner that it can be more simply and more quickly maintained.

A further purpose of the invention is to so design the rolling section of the spinning machine, that in a simple way and manner, the upper rolls can be lifted from the lower rolls by means of swinging away the pressure arms.

Additional objects and advantages of the invention will be set forth in part in the following description, or will be obvious from the description, or may be learned through practice of the invention.

By means of the fact that the pivoting axis of the pressure arm is disposed behind the rolling section in the present invention, after the upward swinging of the pressure arm, the entire area in front of the rolling section becomes freely accessible. Upon the introduction of a new fiber band, this band need no longer be brought in beneath the pivoting axis of the pressure arm, but now the entire area is free and accessible from above and a new band to be introduced can be led in to the rolling section by a service person simply and quickly. A further advantage is that the pivoting geometry of the pressure arm can be substantially more varied, since the area in which the pivoting axis can be placed is considerably larger. For instance, even the area beneath the plane in which the rolling section is situated can be used. Thereby it is possible to better align the swingable upper rolls in relation to the lower rolls. The swinging away of the upper rolls, when these are secured and guided on the journal blocks of the lower rolls, is thereby made easier. In particular, this is true of the swinging away of the upper roll of the exit rolls and especially of the turn-around roll.

The pressure arm can permit these pivoting actions without an auxiliary articulated link so that simultaneously all upper rolls can be positioned in relation to the corresponding lower rolls in essentially one pivoting motion. The pivoting movement component in this case is sufficiently large, to allow the upper rolls to find place in their receptacles, i.e. their guided seats on the journal blocks of the lower rolls.

It is particularly advantageous if the offset between the pivoting axis and the exit rolls of the rolling section runs in the range of between 130 and 490 mm. In this way it becomes possible to simplify the swinging geometry and therewith the positioning of the upper rolls to the lower rolls. An additional achievement is found therein that not only in the case of a spinning machine can the area of a rolling section be easily supervised and serviced by a maintenance person, but also in the case of the matting funnel and the calender rolls which transport the fiber band to storage in the final container. The entire area in front of the rolling section to the storage of the fiber band in its container is thus freely accessible for the maintenance person. A rethreading of the fiber band into the matting funnel, which becomes necessary, following a band break or new insert, is also considerably simplified. It is particularly advantageous if the pivoting axis is installed beneath the plane of the exit rolls of the rolling section. Thereby the alignment of the upper roll of the exit roll to the lower roll is particularly improved. Beyond this, the turnaround roll, which guides the fiber band to the funnel after the last pair of rolling section rolls, is also swung away and subsequently repositioned in a rotary motion against its corresponding lower roll, for instance the exit roll of the rolling section. Simultaneously achieved is that the remaining upper rolls of the rolling section, in spite of this, can be swung in an advantageous geometric arcing manner onto their corresponding lower rolls. The pivoting geometry of the pressure arm as well as that of the upper rolls are further advantageously influenced when the pivoting axis lies beneath the plane which is formed by the tangents to the upper rolls and the lower rolls at the contact line of upper roll and lower roll of the entry roll pair of the rolling section.

It is particularly favorable, when the pivoting axis lies under the plane, which is formed by means of the tangents of the upper roll and lower roll at the contact line of the upper roll and the lower roll of the exit roll pair. It is especially favorable for all the upper rolls, when the pivoting axis of the loading arm lies above the plane which is formed by the tangents at the touching line of the turn-around roll and the roll which operates in conjunction therewith.

By means of the advantageous formation of the spinning machine, by which the pressure means on the pressure arms are secured, and by means of the pivotability of the pressure arm, whereby the said pressure means may be swung away, that for maintenance , i.e. servicing, of the machine, the pressure means need not be taken out of the rolling section by the servicing personnel. It is particularly favorable if the upper rolls are held on the pressure arms, so that, by means of swinging the pressure arm, they are moveable away from the lower rolls. This permits that through the swinging away of the pressure arm, the access into the area of the rolling section is made available to the maintenance person, whereby the fiber band is freely accessible in the rolling section. The upper rolls are advantageously held on the pressure arms by means of holding elements, wherein they are flexibly secured to the pressure arms and can be more easily withdrawn from the guides in the journal block of the lower rolls. It is particularly favorable if the said holding elements are installed to be swingably and angularly disposed to the axis of the upper rolls, a method which greatly eases the insertion of the upper rolls into their receptacles on the said journal blocks. The holding elements are advantageously flexibly designed, in order to ease the putting in and taking out of the upper rolls. Through the correlation of an adjustment rod on the holding element, the advantage is reached that the rigidity of the flexible elements can be varied. By this means, it becomes possible to guide the upper rolls also axially by means of the holding elements. By the design of the holding elements with a guide running angularly to the axis of the upper rolls, the goal is advantageously achieved that the upper rolls are movably arranged precisely within the holding elements.

In a further advantageous development of the invention, it is provided that an interlock apparatus is coordinated with the pressure arms with one or more interlock components and with an activation element as well as a control. By means of this, it is possible to control the locking of the pressure arm in such a manner that various interlocked positions are possible. Advantageously, the interlock apparatus possesses at least two positions, whereby in the first position the upper rolls are not loaded, so that in the case of a long idle period the surfaces of the upper rolls are not damaged. In a second position, the rolling section is under pressure. It is particularly advantageous if the activation element transfers the interlocking apparatus from the second position into the first position and vice versa. The control element is thereby advantageously designed to be a pneumatic cylinder, a hydraulic cylinder, or an electric motor. It is particularly to be preferred if the spinning machine has an arrangement to which a contactor switch is added which produces a signal for the regulation of the control component. This is especially of value when the contactor is installed on the pressure arm. Even better is a situation where the contactor switch is designed as a sensor, which directly, or indirectly determines the offset of the upper rolls to the lower rolls and in dependency of the value thereof, produces a signal. In this way, upon a wrapping formation on one of the rolls, that is, if the fiber band winds up around a rolling section roll, the machine will be shut down. Further, particularly preferentially, the rolling section is relieved of load, so that the winding does not become hard wound, and is thus easier to remove. In further advantageous developments in accord with the invention, the control of the spinning machine can contain a timer, which, upon still-stand and after a predetermined time takes control of the interlock apparatus, so that the pressure arm is released and the rolling section relieved of load. This has the advantage, that the rolls, particularly the outside surfaces, do not develop any pressure spots and the bearings are relieved of load.

In an advantageous development of invention, it is provided that a cleaning wiper rod be installed on the pressure means guides or holding means. It is especially favorable if holding means are provided on the pressure arms for the fastening of a pressure rod. By means of the pressure rod, in accord with a known method, the quality of the stretched fiber band is improved. It is advantageous in this addition to the pressure arms, that the said pressure rod, upon the swinging away of the pressure arm is carried along out of the rolling section so that the insertion of a fiber band into the spinning machine can be accomplished especially simply and quickly, since the pressure rod cannot interfere.

In the following text, the invention will be described with the aid of drawn example presentations of a spinning machine. The invention can be advantageously installed on other spinning machines, for instance on a ring spinning machine, on a flyer, or also on a combing machine.

DETAILED DESCRIPTION OF THE PREFERRED EMBODIMENTS

Figure 1:
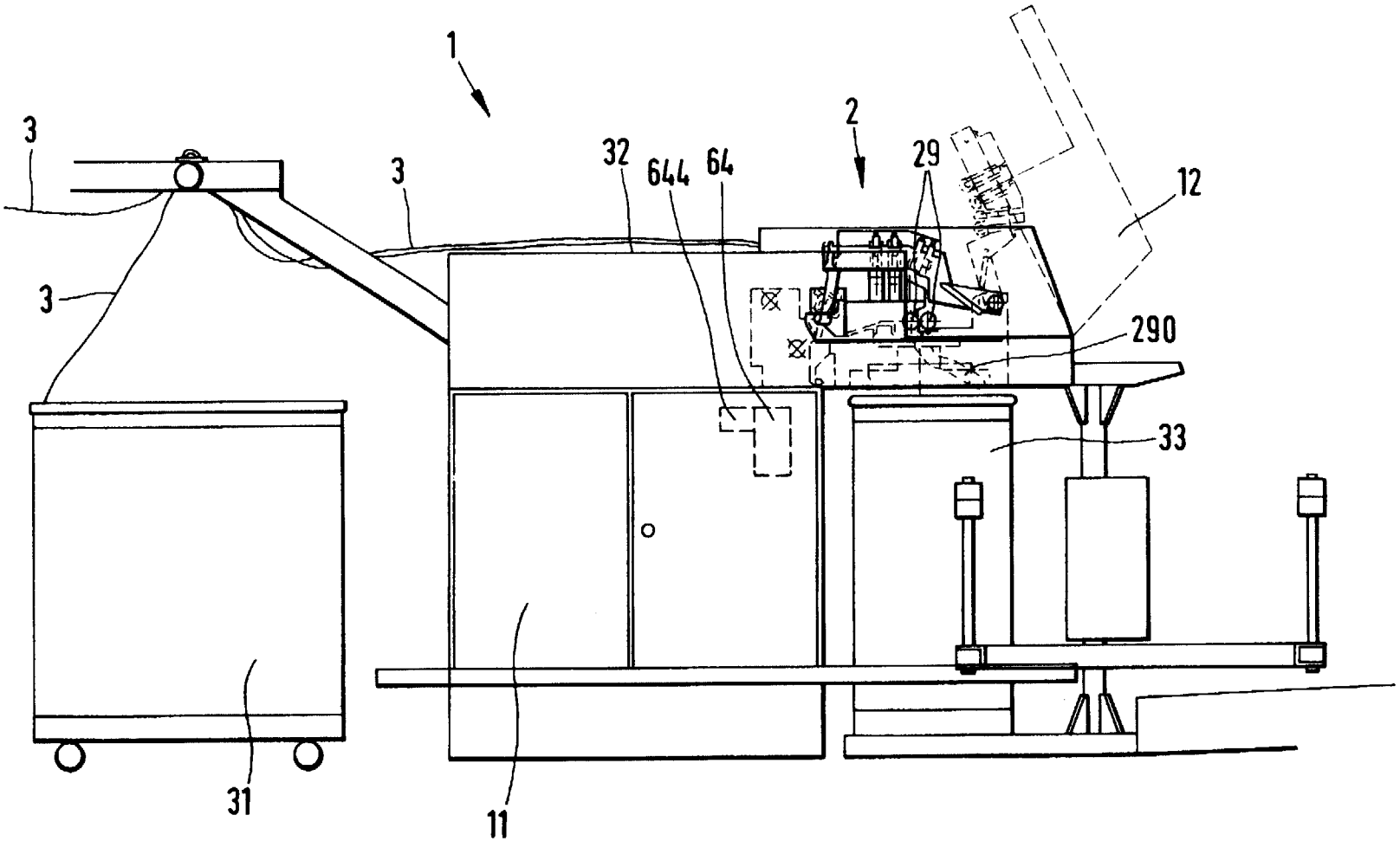
FIG. 1. illustrates a spinning machine in accord with the invention in a schematic presentation.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a further embodiment. It is intended that the present invention cover such modifications and variations.

The spinning machine 1 of FIG. 1 is comprised principally of a housing 11 for the reception of the drive and auxiliary components, as well as the rolling section 2 for the stretching and doubling of the fiber bands 3. These said bands are withdrawn from the supply container 31 and run over a lay-out table 32 of the spinning machine and guided to the rolling section 2. After the fiber band 3 has left the rolling section 2, it is conducted over the calender rolls 29 into a repository tube 290, which is a component of a coiler plate which places the fiber band in a discharge receptacle 33. The rolling section 2 is isolated from the ambient room space by an enclosure 12 which is shown in dotted lines in FIG. 1. The enclosure 12 contains particularly a produced vacuum, which carries away the dust-like material which is released by the stretching. The enclosure can be swung away from the rolling section, wherein this swinging away can be effected in the same direction as the pressure arms. The lower rolls of the rolling section 2 are conventionally turned by belt drive.

Figure 2:
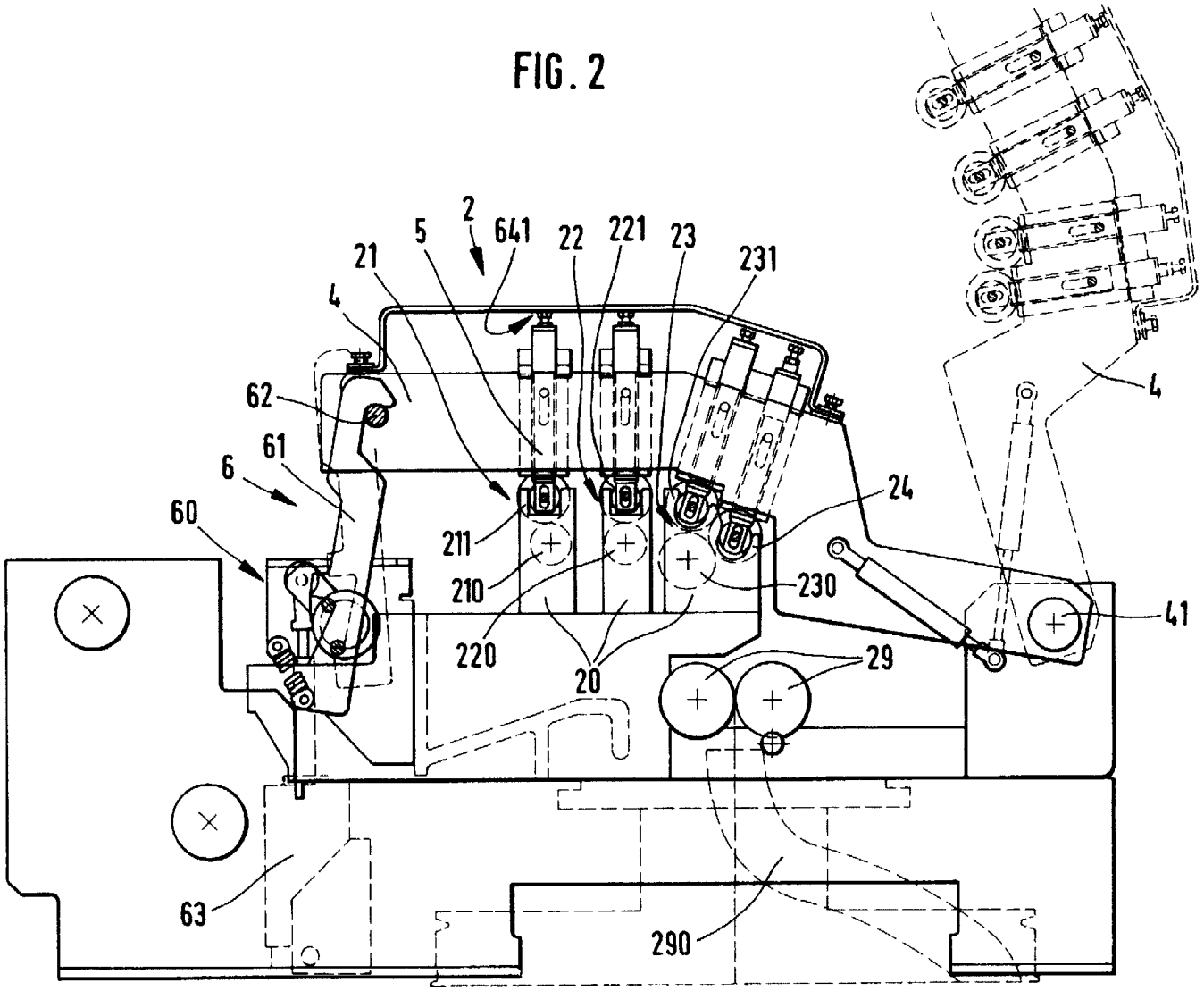
FIG. 2. is a profile view of a rolling section developed in accord with the invention.

FIG. 2 shows the rolling section 2 of the spinning machine of FIG. 1. As is evident from FIG. 1, the fiber band 3 is introduced into the rolling section from the left side (of the drawing), where it is seized between the section rolls and is stretched by means of different RPM's of various pairs of rolls. The rolling section of FIG. 2 is comprised of the entry cylinders 21, the middle cylinders 22 and the exit cylinders 23. The lower roll 230 of the exit cylinder 23 operates in conjunction with a turn-around roll 24. The purpose of this reverse roll 24 is to direct the stretched fiber band to the calender rolls 29. Stretching of the fiber band does not, as a rule, occur by means of the return roll 24. The upper roll 211 of the entry cylinder 21, the upper roll 221 of the middle cylinder 22 and the upper roll 231 of the exit cylinder 23, as well as the return roll 24, are all secured in the pressure arm 4. By means of the swinging away of the pressure arm 4 the upper rolls are lifted from the lower rolls. Regarding the pressure arm 4, only the right pressure arm is presented in the profile view of FIG. 2, "right" being as seen in the direction of travel of the fiber band 3. A fiber band held between the upper and lower rolls thus becomes freely accessible. The swinging away of the pressure arms 4 is done by means of a rotary motion of the pressure arms about their pivoting axis 41, upon which they are swingably hinged by a bearing. In FIG. 2, is shown by dotted lines, the position the pressure arms assume along with the thereto affixed upper rolls when they are swung back for maintenance.

The rolling section is loaded during operation. That is to say, the upper and lower rolls and the fiber band in between are in contact under pressure. For this purpose, pressure means 5 are placed on the upper rolls, which pressure means in their turn are affixed to the pressure arm 4. Accordingly, the pressure arms 4 are drawn in the direction of the rolling section 2 by means of an interlocking system 6, so that the upper rolls 211, 221, 231 are pressed against the lower rolls 210, 220, 230. The interlocking apparatus possesses two loading hooks 61, whereby each pressure arm 4 is allotted one loading hook. The loading hooks 61 engage one bolt 62 per pressure arm 4, whereby a tension brought to bear on the loading hook is transferred to the corresponding pressure arm 4. Upon release of the pressure arm 4 by means of the interlocking apparatus 6, the loading hook, since it no longer is under tension, swings away from the bolt 62, so that now the pressure arms may be pivoted away. The pressure arms exert no force on the rolling section rolls anymore. By means of a spring (not shown), the pressure arm 4, for instance, can be preferably so far lifted that the upper and lower rolls no longer touch one another, so that their surfaces are completely relieved of pressure and in the case of a long period of idleness of the machine, the upper rolls need not be removed.

The rolling section 2 of FIG. 2 is so designed in an embodiment in accord with the invention, that the pivoting axes 41 of the pressure arms 4 are installed with an offset of 270 mm below the lower roll 230 of the exit cylinder 23. At a pivoting angle for the pressure arms of less than 70°, the entire area of the rolling section is freely open for the service person. After the pressure arms are swung up, by a similar formation, the area of the calender rolls becomes freely accessible. The pivoting axis 41 is installed below a plane, where lower roll 230 of the exit cylinder 23 is to be found. At the same time, the pivoting axis 41 of the pressure arms 4 finds itself above a plane E4 which is formed by the tangents of the return roll 24 and the lower roll 230 along their mutual touching line. Likewise the pivoting axis E4 is located below a plane E1, which is formed correspondingly by the tangents at the touching line of the lower roll 210 and the upper roll 211 of the entry cylinder 21. For the sake of clear understanding, the planes E1, E2, E3, and E4 are shown in illustrated form in FIG. 3. By means of this advantageous arrangement of the pivoting axis 41 of the pressure arms 4 the achievement is attained in that the accessibility of the rolling section is guaranteed in ample measure and simultaneously the disposition of the upper rollers to the lower rollers comes into such a relationship, that these can be positioned in an advantageous alignment to one another. In particular, it is possible to place the bearings of the upper rolls in the journal block of the lower rolls and to lift said upper rolls from journal block 20 upon the opening and closing of the rolling section. In more detail, to raise said upper rolls out of the recess 201 of said journal block 20 upon opening and upon closing to reinsert said upper rolls in recess 201. It is due to this positioning that the direction of force of the pressure means 5, which is exerted upon the upper rolls, is aimed toward the rotating axes of the corresponding lower rolls. By this means it becomes possible to swing all the upper rolls out of the journal block of the lower rolls and simultaneously guarantee a favorable direction of force from the pressure means 5.

The interlocking apparatus 6, which allows the pressure arms in conjunction with the upper rolls to bring pressure upon the lower rolls and to interlock, is comprised of an interlocking element 60, onto which a control element 63 connects and brings about such an action that the loading hook 61 transfers from its "open" position (which is presented in dotted lines) to its "closed" position (shown in solid lines). During this, the bolt 62 in the closed position of the rolling section remains always positioned at the same place. The result of this is that the pressure means 5 exert a predetermined force by means of a simple adjustment on the rolling section cylinder. The magnitude of the force, which is brought by means of the control element 63 has no influence on the force with which the upper rolls press upon the lower rolls. The position of the loading hook and also that of the pressure arms is always the same in the closed position. The control element 63 is comprised of a pneumatic cylinder, which is connected by a line (not shown) to a control valve. The control valve in turn is controlled by a regulator 64. In FIG. 1 the controller 64 is schematically represented. The controller 64 can be activated by a push button (not shown) which can be pressed by an operator for the purpose of bringing the rolling section into an open or closed position. Moreover, the control 64 is connected with two mutually independently working contactors, which send a signal to the control to transfer the roll section from the closed to the open position. One of the signal emitters is the contactor 641, which advantageously is installed on each of the two pressure means of an upper roll. The contactor 641 is comprised of a signal rod 642 and a contact rail 643 (see FIG. 3 and FIG. 4). Upon disturbance in the roll section, in particular in the case of a so called wind-up in which the fibers wind themselves around a roll thereby increasing the distance of the upper rolls from the lower rolls, the signal rod 642 is pushed in the direction of the contact rail 643.

Upon the contact of the signal rod 642 with the contact rail 643 an electrical signal is produced and sent to the control 64 . By means of the subsequent reaction of the signal 64 the pressure arms are released from the interlock and the offset between the upper roll and the lower rolls can be freely adjusted. This has the positive result that the one or more windings of fibers on the rolls, the so called "Wind-up" is formed more loosely. Thereby its removal from the roll can be substantially made easier.

The previously above mentioned second signal emitter is designed in accord with the invention as a time switch 644, which is presented schematically in FIG. 1. The time switch 644 is so designed, that it is only active when the roll section is at still-stand and the interlock apparatus 6 finds itself in its second position, that is, when the roll section is loaded. The time switch operates in such a manner, that after a predetermined still-stand time lapse, automatically a signal is given to the control 64, which thereupon transfers the interlocking apparatus from the second position to the first position, so that the roll section is relieved of pressure. This is to protect the rolls, since otherwise upon still-stand their surfaces could develop pressure spots. The duration, following which the time switch 644 gives its signal, lies preferably in the range of 0.5 to 1 minute. The time can be advantageously increased on an individual basis by the operator. It is not realistic to release the rolling section too quickly, because the operator then has no opportunity to take action, before possible damage may be done to the band due to the release of pressure. Particularly advantageous would be to adjust the said time-lapse to 1 to 4 minutes.

Figure 3:
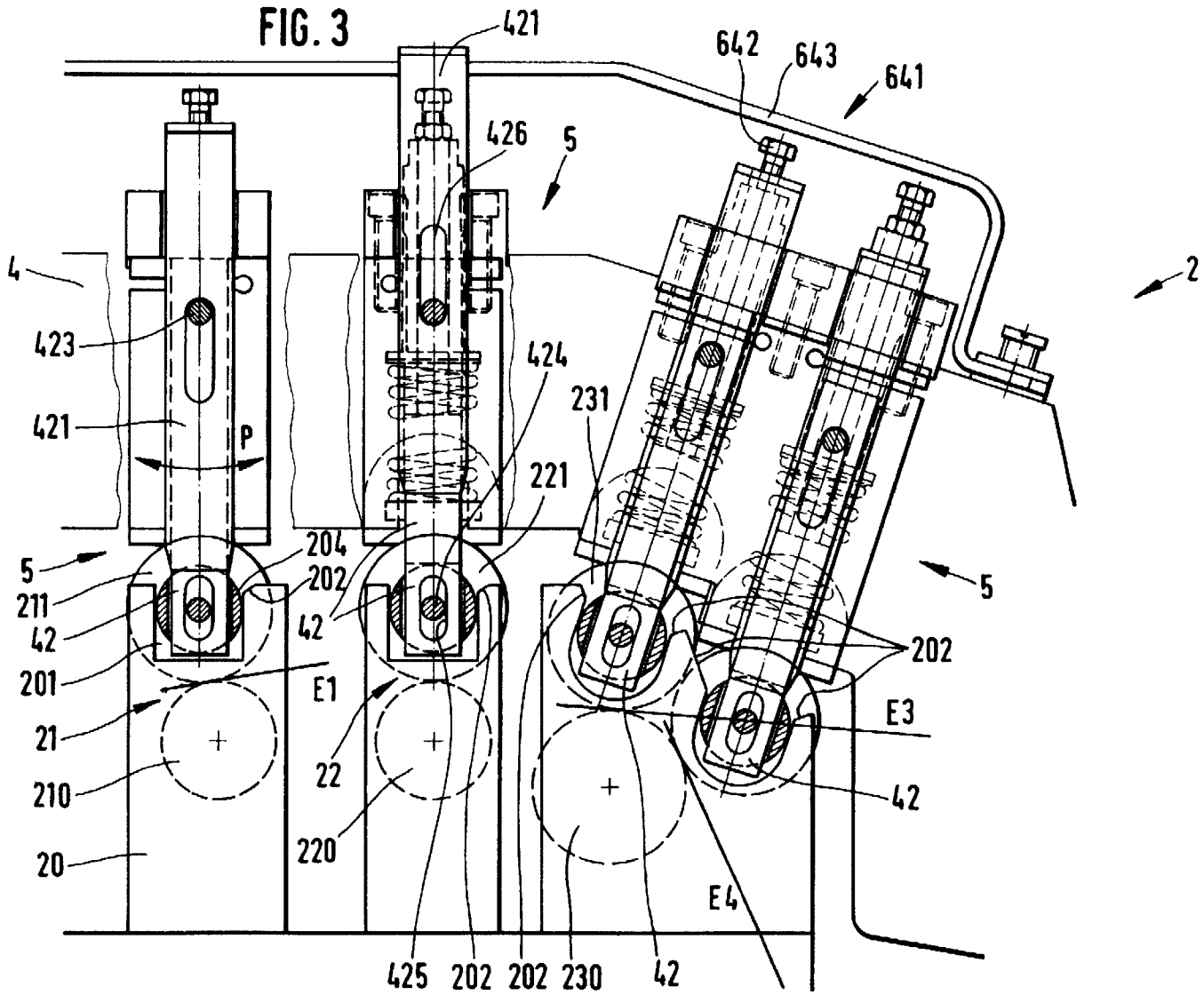
FIG. 3. is a profile view of the fastening means of the upper rolls on the pressure arms.

FIG. 3 shows the principal elements of the rolling section 2 of FIG. 2 in a profile view, whereby some components, for instance the lower rolls, are shown with dotted lines. Likewise the pressure arm 4 is only sketchily depicted, since otherwise the pressure means 5 would be covered (see FIG. 4, pressure arm 4, right side). In accord with the invention, the upper rolls 211, 221, 231 and the return roll 24 are secured in flexible retaining elements 42. The retaining elements 42 are held in place on the pressure means 5 by a securing means 423, normally a screw. The securing means 423 is of such a kind that the retaining elements 42 about said securing means 423 are pivotable (see double arrow P). This mobility allows that the insertion of the upper rolls into the recess 201 of the journal block of the lower rolls can be done easier. The recess 201 for the upper rolls advantageously possesses for this insertion an inclined insertion guide, which additionally aids in easing the insertion of the upper rolls. So that the bearing 203, i.e. the outer ring thereof, is prevented from turning with the shaft, the holding element 42 is embedded in a slot 204 of the said outer ring.

The holding elements 42 are each comprised of a flexible, thin sheet metal part, which possesses an extended long slot 425 for the reception of the upper roll. Into this the upper roll protrudes with a shaft end pin 424 and is secured thereby. By means of the design of the long slot 425, the upper rolls can be so guided, even during the operation, within their holding elements, that changes of the axis-offsets between the upper rolls and the lower rolls cause no problem. The shaft end tip of the upper roll, which on each side penetrates the long slot 425 of the holding element 42, can adjust itself sufficiently in this long slot. The long slot 425 forms a guide for the upper rolls.

In the pressure element 5 is provided at times an adjustment 421, which is slidably mounted on the pressure means 5. The adjustment device 421 is guided by, among other things, the securement means 423. The adjustment means 421 possesses a slot 426, by which it can be moved angularly in the direction of the upper roll through a distance in accord with the length of said slot. The adjustment 421 serves to limit the holding element 42 in its movability in the direction of the axis of the upper roll. This is so that the holding element 42 which carries the upper roll 211 of the entry cylinder 21 is limited by the adjustment 421 when said adjustment is in its lower position. The holding element 42 of the middle cylinder 22, on the other hand, is axially movable in the direction of the upper roll 221, since the adjustment 421 is pushed to the upper position. What is achieved by means of the increase of the movement of the holding elements 42, is that the upper rolls in the case of swung back pressure arms 4 can be more easily removed. This comes about since the flexible holding elements 42 can be shoved in the direction of the axes, whereby the shaft end tip 424 of the upper rolls can be more easily extracted from the long slot of the holding element 42. The limitation of the movement of the holding elements 42 by means of the adjustment 421 has the advantage that the holding elements are then also in a position to guide the upper rolls axially, so that no guide means is necessary on the recess 201 of the journal block 20.

Figure 4:
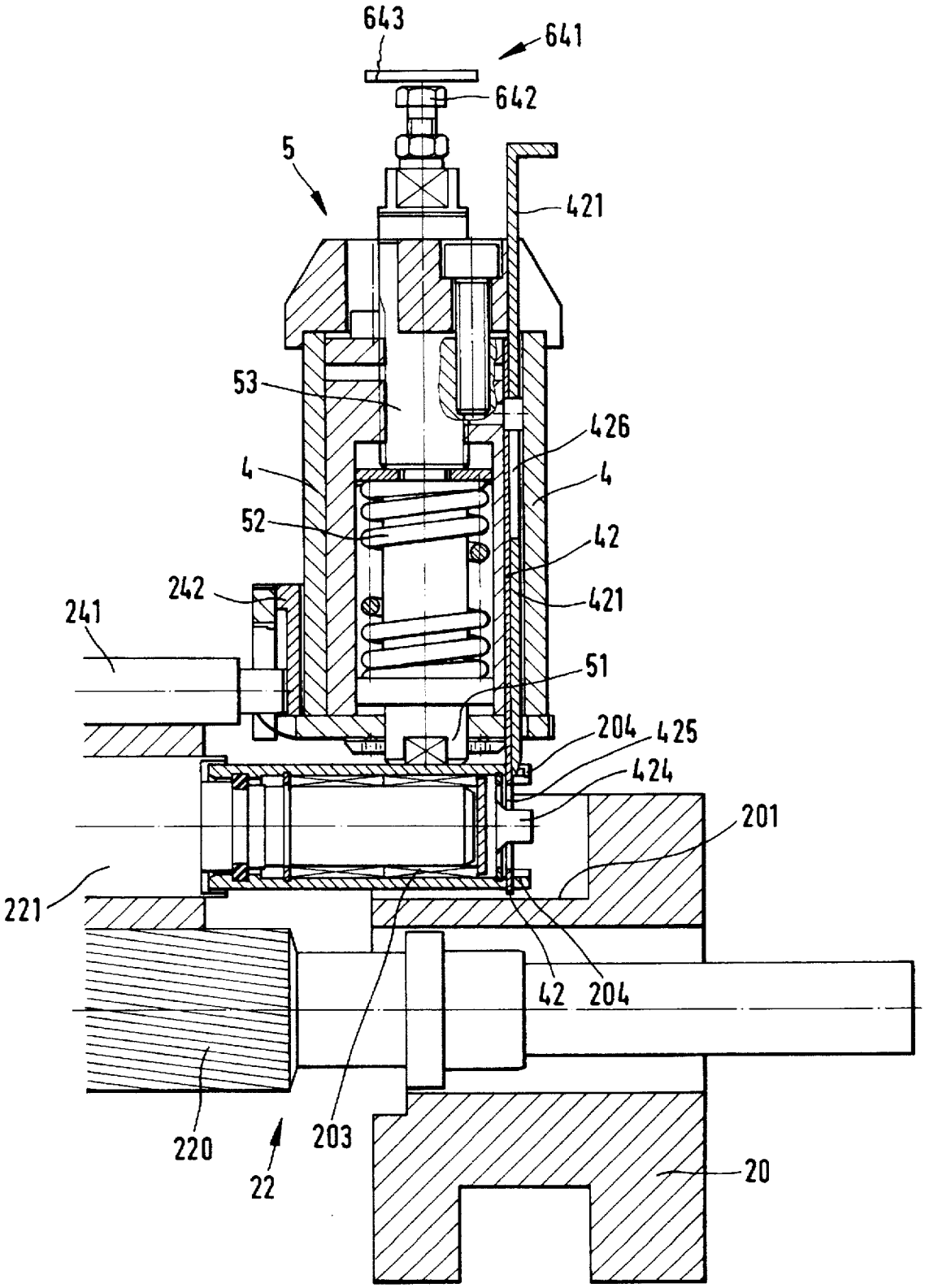
FIG. 4. is a sectional drawing of a pressure means with holding elements.

FIG. 4 shows a sectional presentation through a pressure element 5, which is seen in the running direction of the fiber band and on the right side of the roll section 2. The pressure means 5 is installed between the right and left part of the pressure arm 4, which arm is assigned to this side of the roll section. In principle, the entry, middle, and exit cylinders resemble one another, so that this presentation is valid for all, and further also for the reverse roll 24. The upper roll 221 is installed in the recess 201 of the journal block 20 of the lower roll 220 of the middle cylinder 22, which roll is depicted here as an example. The upper roll 221 does not support itself toward the lower roll 220 by its bearing 203, but supports itself solely on the lower roll 220. The pressure means 5 presses by means of a pressure rod 51 on the upper roll 221. The pressure rod 51 is loaded by the spring 52, which in turn is pretensioned by an adjusting screw 53. Penetrating through the adjusting screw 53 is found a signal rod 642 extending to the pressure rod 51 , so that the pressure rod 51 represents the position of the upper roll, and with these data, as explained above, together with the contact rail 643 forms a contact means 641 for the interlocking apparatus 6. Upon the touching of the signal rod 642 against the contact rail 643, the signal for the controller 64 is released.

Moreover, on the pressure means 5, advantageously a holder for a cleaning rod 241 is installed. In this case it is also possible upon change of position of the pressure arm 4, simultaneously also to change the position of the cleaning rod. The cleaning rod is conventionally movably mounted in bearings in its securement 242 and lies by its own weight upon the upper roll, for the purpose of cleaning said roll during operation. Since, the securement 242 of the cleaning rod 241 is attached to the pressure means 5 and not to the pressure arm 4, it becomes an especially advantageous possibility upon the change of position of the pressure means 5 to also simultaneously change the position of the securement of the cleaning rod 241 with it. A change of position of the pressure means is, for instance, required, when the offsets of the cylinders of the rolling section are varied.

FIG. 4 presents, moreover, a sectional drawing of the holding means 42 and the adjustment 421. The adjustment 421 is shown in the lower position in which it limits the axial motion of the flexible holding elements 42. This is the position as it is found during the operation of the rolling section. By means of this embodiment it is advantageously possible to guide the upper rolls with the holding elements 42 simultaneously in an axial direction. If the adjustment 421 is placed in the raised position, (see FIG. 3, middle cylinder 22), then, as already described, the holding element 42 is yieldable in the axial direction, whereby the shaft end tip 424 would come out of the long slot 425 of the holding element 42 and the upper roll 221 can be taken out. The movability of the of the adjustment 421 is limited by the slot 426.

Even in the manner of a cleaning rod 241, also a (not shown) pressure rod can be advantageously affixed to the pressure means 5. In this case, it is not foreseen, contrary to the cleaning rod, that the said pressure rod in its securement is so held, that it can move freely upward, the pressure rod lies much more with pressure on the fiber band. The attachment of said pressure rod directly on the pressure arm is also possible, since the pressure rod need not be, in practice, pushed into the rolling section, since it is installed in the area of the exit cylinder 23, which is not changeable in position.

It should be apparent to those skilled in the art that various modifications and variations can be made in the invention without departing from the scope and spirit of the invention. It is intended that the present invention cover such modifications and variations as come within the scope of the appended claims and their equivalents.

What is claimed is:

1. A textile spinning machine for doubling or stretching fiber bands, comprising:

a rolling section having pairs of upper and lower rolls, said lower rolls held in journal blocks, wherein said fiber band is conveyed between said upper and lower rolls in a conveying direction, said pairs of rolls including an entering pair of rolls and an exit pair of rolls in said conveying direction;

pressure mechanisms disposed to load said upper rolls toward said lower rolls;

a pivotally mounted pressure arm, said pressure mechanisms mounted on said pressure arm, said pressure arm pivotable between a closed position wherein said pressure mechanisms load said upper rolls against said lower rollers, and an open position wherein said upper rolls are unloaded relative to said lower rolls; and a pivot axis for said pressure arm which is disposed behind said rolling section in said conveying direction and below a horizontal plane through a rotational axis of said lower roll of said exit rolls.

2. The textile spinning machine as in claim 1, further comprising an offset between said pivot axis and lower roll of said exit rolls in a range of generally 130 mm and 490 mm.

3. The textile spinning machine as in claim 1, further comprising an offset between said pivot axis and lower roll of said exit rolls in a range of generally 200 mm and 300 mm.

4. The textile spinning machine as in claim 1, wherein said pivot axis is disposed below a tangent plane defined by a tangent of said entering rolls at a contact line between said entering rolls.

5. The textile spinning machine as in claim 4, wherein said pivot axis lies in a range of generally 20 mm to 100 mm below said tangent plane.

6. The textile spinning machine as in claim 1, wherein said pivot axis is disposed below a tangent plane defined by a tangent of said exit rolls at a contact line between said exit rolls.

7. The textile spinning machine as in claim 1, further comprising a return roll in rotational contact with said lower roll of said exit rolls, said pivot axis disposed above a tangent plane defined by a tangent at a contact line between said return roll and said lower roll of said exit rolls.

8. The textile spinning machine as in claim 1, wherein said upper rolls are mounted on said pressure arm so as to be swung away from said lower rolls upon pivoting of said pressure arm about said pivot axis.

9. The textile spinning machine as in claim 8, further comprising movable securing elements for holding said upper rollers on said pressure arm, said securing element movable relative to said pressure arm angularly with respect to the rotational axis of said upper rolls.

10. The textile spinning machine as in claim 9, wherein said securing elements comprise flexible securing members.

11. The textile spinning machine as in claim 10, further comprising an adjusting device configured with said securing elements for increasing rigidity of said flexible securing members.

12. The textile spinning machine as in claim 8, wherein said securing elements further comprise an elongated guide for flexibly mounting said upper rollers thereto, wherein said upper rolls are movable relative to said lower rolls in a range of generally 2 mm to 20 mm.

13. The textile machine as in claim 1, wherein said pressure mechanisms are disposed on said pressure arm angularly with respect to the rotational axis of said upper rolls.

14. The textile machine as in claim 1, further comprising a controllable interlock mechanism configured with said pressure arm to lock said pressure arm in said closed position and upon release thereof automatically releases said pressure arm from said closed position to said open position.

15. The textile machine as in claim 14, wherein in said open position of said pressure arm said pressure mechanisms are out of loading contact with said upper rolls and in said closed position of said pressure arm said pressure mechanisms are brought into loading contact with said upper rolls to load said upper rolls against said lower rolls.

16. The textile machine as in claim 14, further comprising a pneumatic or hydraulic control element for controlling said interlock mechanism.

17. The textile machine as in claim 14, further comprising a control element configured to automatically release said interlock mechanism whereby said pressure arm moves to said open position and said upper rolls are unloaded relative to said lower rolls, said control element further comprising a contact component which generates a control signal for said control element to automatically release said interlock mechanism.

18. The textile machine as in claim 17, wherein said contact component is disposed relative to said pressure arm to respond to excess offset between said upper and lower rolls.

19. The textile machine as in claim 14, further comprising a control element configured to automatically release said interlock mechanism whereby said pressure arm moves to said open position and said upper rolls are unloaded relative to said lower rolls, said control element further comprising a time switch component which generates a control signal for said control element to automatically release said interlock mechanism upon a predetermined stand still period of time for said upper and lower rolls.

20. The textile machine as in claim 1, further comprising a cleaning staff mounted on said pressure arm for continuously wiping said upper rolls.

21. The textile machine as in claim 1, wherein said upper rolls are held in recesses defined in said journal blocks for said lower rolls.

* * * * *

UNITED STATES PATENT AND TRADEMARK OFFICE

CERTIFICATE OF CORRECTION

PATENT NO. : 5,799,374

DATED : SEPTEMBER 1, 1998

INVENTOR(S) : STROBEL ET AL.

It is certified that error appears in the above-indentified patent and that said Letters Patent is hereby corrected as shown below:

On the title page, item [56]:

IN THE REFERENCES CITED SECTION

Please change "Schrotz" to --Schulz--.

IN THE ABSTRACT

Please substitute the following Abstract submitted during prosecution of the application for the Abstract issued with the patent.

A textile spinning machine for stretching fiber bands includes a rolling section with pairs of upper and lower rolls. The lower rolls are held in journal blocks and a fiber band is conveyed between the upper and lower rolls in a conveying direction. Pressure mechanisms are disposed to load the upper rolls toward the lower rolls in operation of the textile machine. A pivotally mounted pressure arm is provided which pivots between a closed position wherein the pressure mechanisms load the upper rolls against the lower rolls, and an open position wherein the upper rolls are unloaded relative to the lower rolls.

UNITED STATES PATENT AND TRADEMARK OFFICE

CERTIFICATE OF CORRECTION

PATENT NO. : 5,799,374

DATED : SEPTEMBER 1, 1998

INVENTOR(S) : STROBEL ET AL.

It is certified that error appears in the above-indentified patent and that said Letters Patent is hereby corrected as shown below:

The pivot axis for the pressure arm is disposed behind the rolling section in the conveying direction and below a horizontal plane through a rotational axis of the lower roll of the exit pair of rolls.

Signed and Sealed this

Thirtieth Day of November, 1999

*Attest:*

*Attesting Officer*

Q. TODD DICKINSON

*Acting Commissioner of Patents and Trademarks*